US011673233B2

(12) United States Patent
Mendez

(10) Patent No.: US 11,673,233 B2
(45) Date of Patent: Jun. 13, 2023

(54) DEVICE FOR SMOOTHING WINDOW TINTING AND GRAPHICS APPLICATION TOOLS

(71) Applicant: Tri-Edge Industries, LLC, Lake Worth, FL (US)

(72) Inventor: Jay Mendez, Greenacres, FL (US)

(73) Assignee: TRI-EDGE INDUSTRIES, LLC, West Palm Beach, CA (US)

( * ) Notice: Subject to any disclaimer, the term of this patent is extended or adjusted under 35 U.S.C. 154(b) by 999 days.

(21) Appl. No.: 16/444,743

(22) Filed: Jun. 18, 2019

(65) Prior Publication Data

US 2020/0398403 A1 Dec. 24, 2020

(51) Int. Cl.

| | |
|---|---|
| ***B24D 15/04*** | (2006.01) |
| ***B24D 15/02*** | (2006.01) |
| ***B24D 3/00*** | (2006.01) |

(52) U.S. Cl.

CPC ..... *B24D 15/04* (2013.01); *B24D 3/008* (2013.01); *B24D 15/023* (2013.01)

(58) Field of Classification Search

CPC ..... B24D 3/008; B24D 15/023; B24D 15/04; B24D 15/081; B24D 15/084; B24D 15/085; B24D 15/088; B24D 15/105

USPC ..... 451/313, 316, 490, 513, 514, 515, 523, 451/525; 76/81, 81.1, 81.2, 81.3, 81.5; 15/209.1, 210.1

See application file for complete search history.

(56) References Cited

U.S. PATENT DOCUMENTS

| | | | | | |
|---|---|---|---|---|---|
| 3,708,924 | A * | 1/1973 | Prunchak | B24D 15/02 | 15/250.43 |
| 4,065,887 | A * | 1/1978 | Shrader | B24D 15/02 | 451/523 |
| 4,377,057 | A * | 3/1983 | Pincha | B24D 15/023 | 451/514 |
| 4,617,765 | A * | 10/1986 | Weiler | B24D 15/00 | 451/515 |
| 4,934,110 | A * | 6/1990 | Juranitch | B24D 15/081 | 76/82 |
| 5,706,835 | A * | 1/1998 | Salvino | A45D 29/11 | 132/73 |
| 5,782,681 | A * | 7/1998 | Bresnahan | B24D 15/00 | 451/523 |
| 5,947,803 | A * | 9/1999 | Gruner | B24D 15/04 | 451/354 |
| 6,171,177 | B1 * | 1/2001 | Fitz | G02B 6/4498 | 451/313 |

(Continued)

*Primary Examiner* — Eileen P Morgan

(74) *Attorney, Agent, or Firm* — Malloy & Malloy, P.L.; Robert M. Downey

(57) ABSTRACT

A device for smoothing a working edge of a squeegee tool that is used for application of film substrates to glass surfaces; the device having a main body including a base and opposing first and second panels extending away from the base and diverging away from one another to define an open mouth, and a fabric sheet secured to the main body at opposite end portions, and the fabric sheet including a central portion received within the open mouth and formed in a V-shape transverse configuration, wherein the working edge of the tool is moved longitudinally between the opposing panels and in frictional engagement with a top surface of the fabric sheet at a bottom of the V-shape to effectively remove bumps, nicks and scratches on the working edge of the tool.

1 Claim, 5 Drawing Sheets

(56) References Cited

U.S. PATENT DOCUMENTS

| | | | | |
|---|---|---|---|---|
| 6,322,266 | B1 * | 11/2001 | Traynor | A46B 5/06 15/160 |
| 7,048,618 | B1 * | 5/2006 | Cramer | B24D 15/023 451/525 |
| 7,955,163 | B2 * | 6/2011 | Kozak | B24B 19/009 451/518 |
| 8,858,304 | B2 * | 10/2014 | Andonian | B24D 15/023 451/523 |
| 2007/0178816 | A1 * | 8/2007 | Lin | B24D 15/02 451/523 |

* cited by examiner

DEVICE FOR SMOOTHING WINDOW TINTING AND GRAPHICS APPLICATION TOOLS

BACKGROUND OF THE INVENTION

Field of the Invention

The present invention relates to a device for smoothing the edges of squeegees and similar window tinting and graphics application tools, and more particularly, to a manually operated device that includes a fabric sheet that is positioned for movement of the working edge of the squeegee or other tool against the fabric in order to remove surface irregularities and smooth the working edge of the tool.

Discussion of the Related Art

Applying tint film or other graphics application films to windows or other glass surfaces requires the use of a squeegee and/or other film application tools. These window tinting and graphics application tools typically have a working edge that is pressed against and moved along the film for pushing liquid and air bubbles between the film and the glass towards an edge of the film, thereby removing the bubbles and liquid so that the film becomes completely and uniformly adhered to the glass surface. Over the course of time, the working edge of the tool can get scratched, nicked or otherwise damaged. When this happens, the working edge can cut or damage the film when applying the tinting film or other graphics films to window or other glass surfaces.

Accordingly, it is essential that the working edge of squeegees and other window tinting and graphics application tools be maintained smooth without scratches, bumps, nicks or other surface irregularities that might otherwise damage the tinting film or graphics film being applied to the window or other glass surface.

SUMMARY OF THE INVENTION

The present invention is directed to a device for smoothing the edges of squeegees and other window tinting and graphics application tools. The device includes a main body having a base and opposing panels each having a lower portion, an upper portion, and a top distal edge extending longitudinally between opposite first and second ends of the main body. The panels extend upwardly from the base at the lower portions and diverge away from one another beginning at the upper portions, eventually terminating at the top distal edges to define an open mouth between the opposing panels. A fabric sheet is secured to the main body and includes a central portion that extends over the top distal edges of the opposing panels within the open mouth. The central portion of the fabric sheet is tucked down between the opposing panels to assume a V-shape between the upper portions of the opposing panels. By sliding a working edge of the window tinting and graphics application tool longitudinally between the opposing panels and in frictional engagement with the fabric sheet at the bottom of the V-shape, bumps, nicks, scratches and other irregularities are removed from surfaces along the working edge, to thereby smooth the working edge of the tool.

In a preferred embodiment, the fabric sheet includes an arrangement of closely spaced parallel ridges on at least a top surface of the fabric sheet that faces inwardly within the V-shape. The parallel ridges extend perpendicular to the longitudinal directional path of movement of the working edge of the tool between the opposing panels, which allows the parallel ridges to rub against the surfaces of the working edge of the tool to enhance smoothing of the working edge.

OBJECTS AND ADVANTAGES OF THE INVENTION

Considering the forgoing, it is a primary object of the present invention to provide a device for smoothing the edges of squeegees and other window tinting and graphics application tools in order to remove bumps, nicks, scratches and other irregularities on the working edge of the tools.

It is a further object of the present invention to provide a device for smoothing the edges of squeegees and other window tinting and graphics application tools, and wherein the device is entirely manually operated without the need for moving parts or electric power.

It is still an object of the present invention to provide a simple and effective device for smoothing the edges of squeegees and other window tinting and graphics application tools, and wherein the device is easy to use.

It is still an object of the present invention to provide a device for smoothing the edges of squeegees and other window tinting and graphics application tools, and wherein the device is inexpensive and highly effective to extend the useful life of squeegees and other window tinting and graphics application tools.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
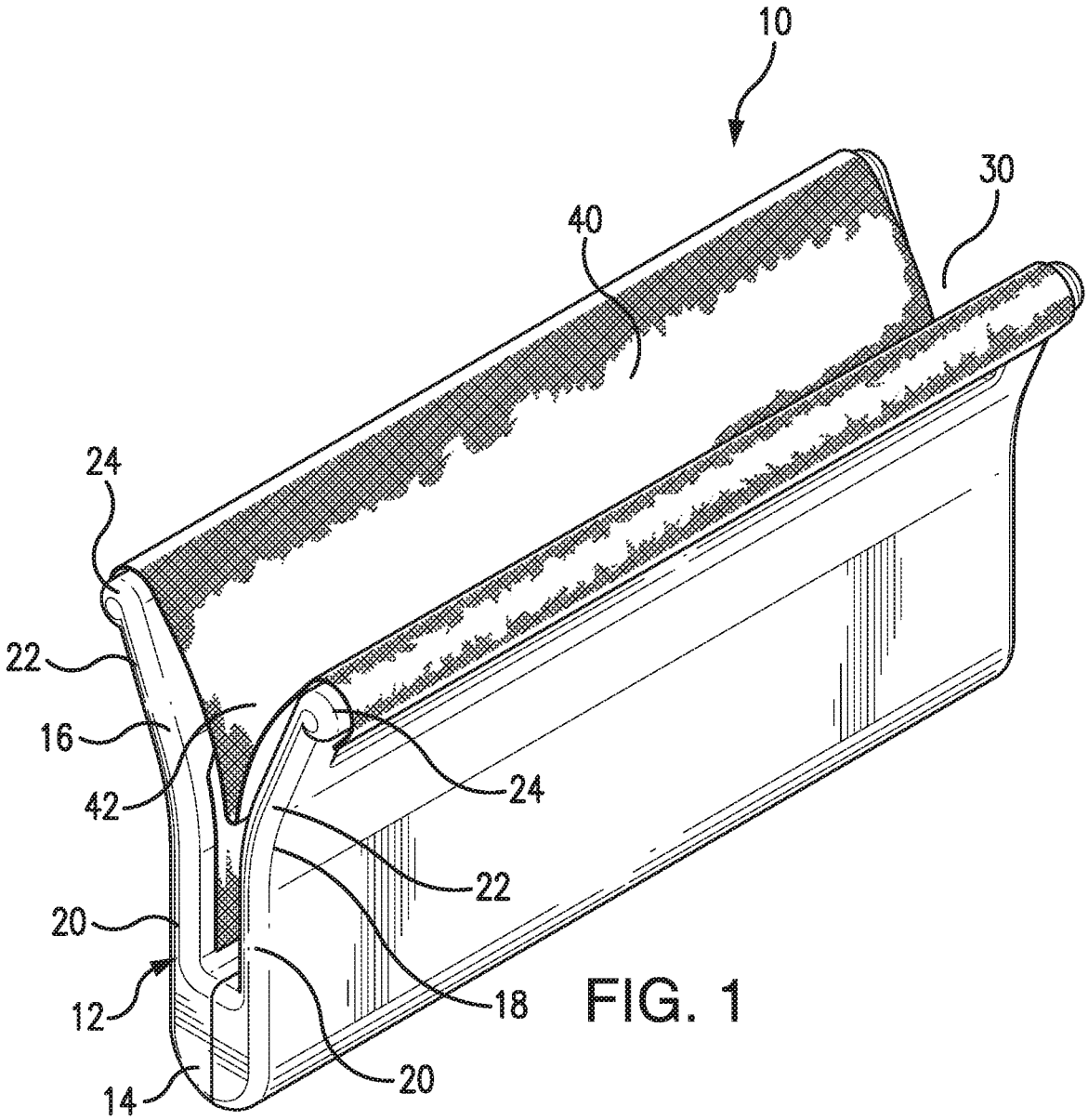
FIG. 1 is a front, top perspective view of the device of the present invention.

The device for smoothing window tinting and graphics application tools is shown and is generally indicated as 10 throughout the several views of the drawings. Referring initially to FIG. 1, the device 10 includes a main body 12 having a base 14 and opposing panels 16 and 18, each having a lower portion 20, an upper portion 22 and a top distal edge 24 extending longitudinally between opposite ends of the main body 12. The opposing panels 16, 18 extend upwardly from the base 14 at the lower portions and diverge away from one another beginning at the upper portions 22, eventually terminating at the top distal edges 24 to define an open mouth 30 between the opposing panels 16, 18. A fabric sheet 40 is secured to the main body 12 and includes a central portion 42 that extends over the top distal edges of the opposing panels 16, 18 within the open mouth 30. The central portion 42 of the fabric sheet 40 is tucked down between the opposing panels to assume a V-shape between the upper portions of the opposing panels 16, 18. By sliding a working edge 52 of the window tinting and graphics application tool 50 longitudinally between the opposing panels 16, 18 and in frictional engagement with the fabric sheet 40 at the bottom of the V-shape, bumps, nicks, scratches and other irregularities are removed from the surfaces along the working edge 52, to thereby smooth the working edge of the too.

Figure 2:
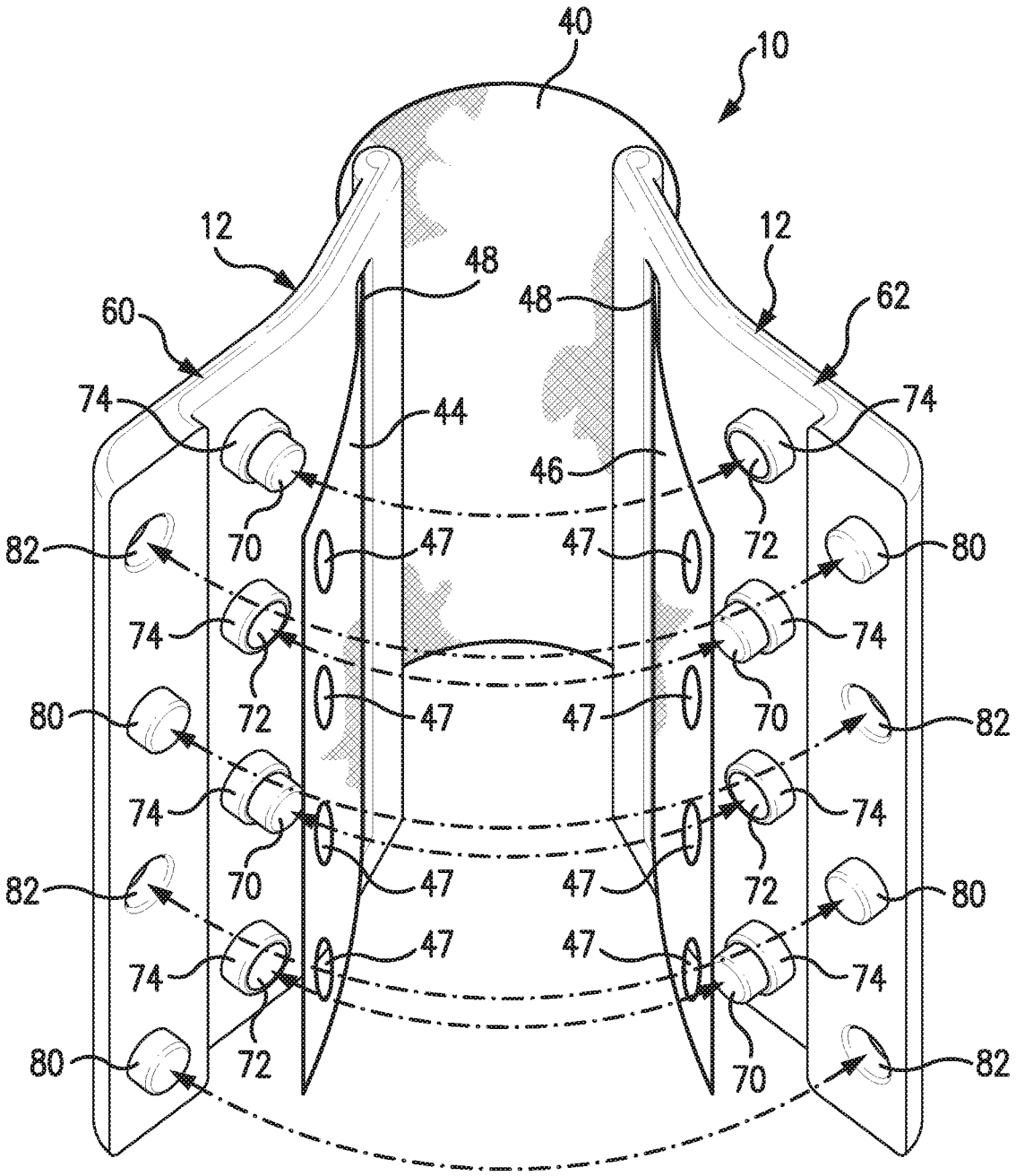
FIG. 2 is a bottom, side perspective view showing two symmetrical halves of the device separated for assembly of the device including a fabric sheet that is secured to the main body of the device, between the symmetrical halves.
Figure 3:
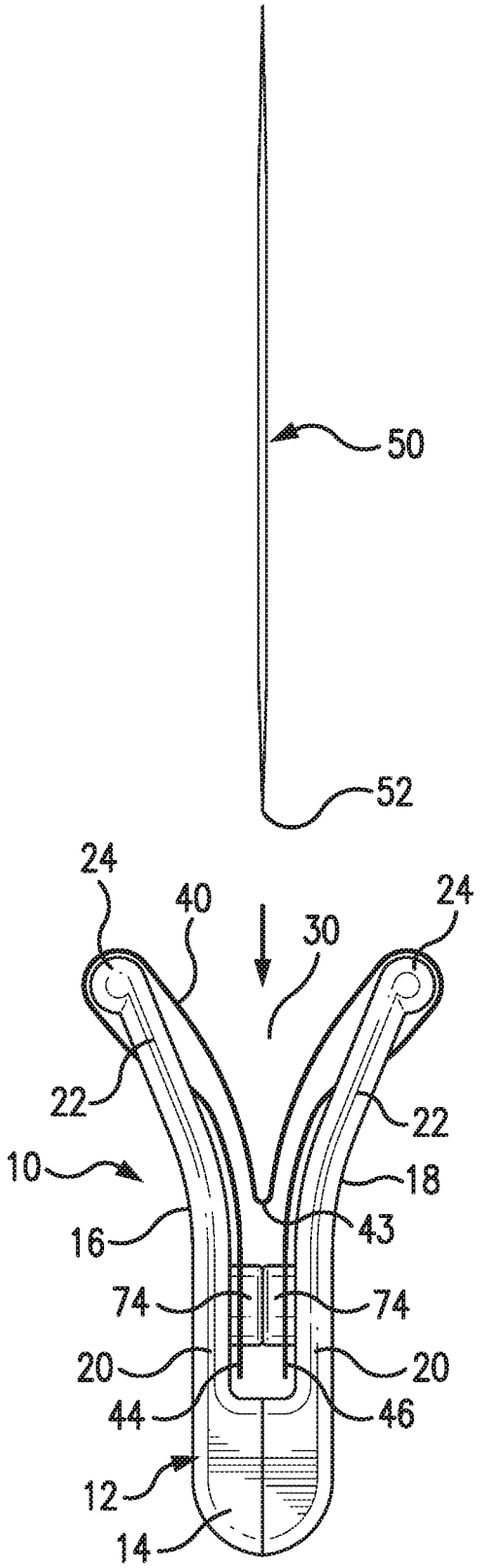
FIG. 3 is a side elevational view showing the device of the present invention and a squeegee or other window tinting and graphics application tool above an open mouth of the device and ready for receipt within the open mouth, as indicated by the arrow, for smoothing a working edge of the tool.
Figure 4:
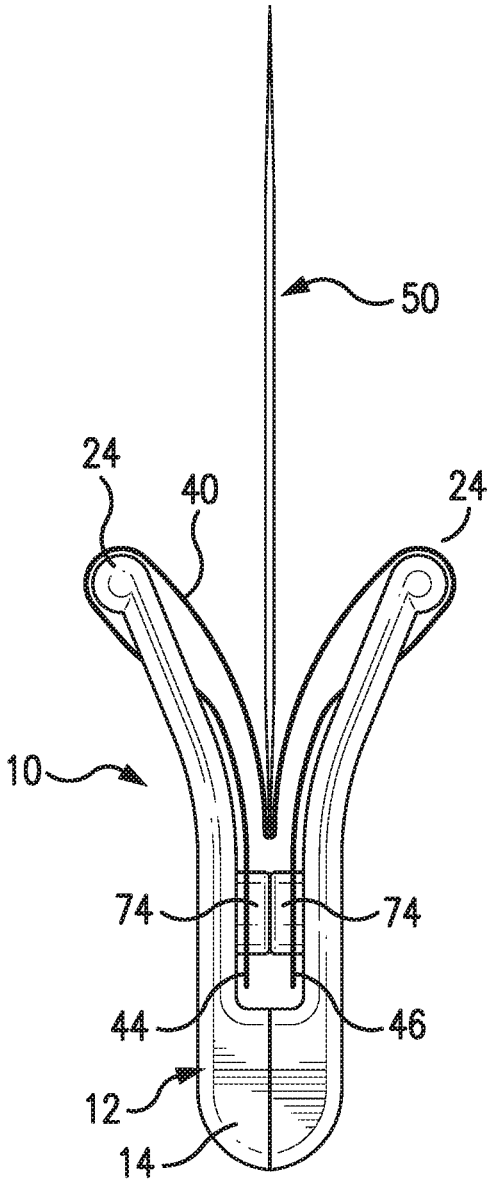
FIG. 4 is a side elevational view showing the squeegee or other window tinting and graphics application tool within the open mouth of the device of the present invention and in frictional engagement with a fabric sheet for smoothing the working edge of the squeegee or other tool.

Referring to FIG. 2, the main body 12 of the device 10 is constructed as two symmetrical halves 60, 62. Each half 60, 62 includes a portion of the base 14, and one of the opposing panels 16, 18. As seen in FIG. 2, the fabric sheet 40 is fitted through elongate slots 48 on the upper portions of each of the opposing panels so that opposite end portions 44, 46 of the fabric sheet are extended down towards the opposing portions of the base between the two symmetrical halves 60, 62. The opposite end portions 44, 46 of the fabric sheet 40 are provided with a plurality of holes 47 for passage of pegs 70 therethrough on the opposing halves of the main body. In particular, the pegs 70 are positioned on the lower portions 20 of the opposing panels 16, 18 of each of the halves 60, 62, and are specifically structured and positioned for passage through respectively aligned holes 47 in the opposite ends 44, 46 of the fabric sheet 40 and into a receiving hole 72 on the opposing lower portion 20 of the opposite panel 16 or 18. The receiving hole 72 and pegs 70 are each surrounded by a hub 74 so that when the pegs are positioned within the receiving holes on the opposite panels, the hubs 74 are positioned in abutting relation, as seen in FIGS. 3 and 4. As seen in FIGS. 3 and 4, the hubs 74 act as spacers between the lower portions 20 of the opposing panels 16, 18, maintaining the opposing panels in the proper spaced relation, while adding support to the lower portions 20 and the main body 12, just above the base 14. The opposing portions of the base 14 of each of the symmetrical halves 60, 62 are also provided with correspondingly aligned pegs 80 and holes 82 which fit together to hold the base portions of each of the symmetrical halves together so that the formed base 14 of the main body 12 is held solid while preventing unwanted movement between the opposing halves 60, 62. The opposing base portions of the symmetrical halves 60, 62 may be fastened together with threaded fasteners, such as a screw, in addition to the pegs 80 and holes 82. Moreover, the pegs 80 and holes 82 may be structured to provide a snap-fit tight attachment of the two opposing base portions of the symmetrical halves 60, 62, to secure the base 14 closed, as seen in FIGS. 1, 3 and 4.

Figure 5:
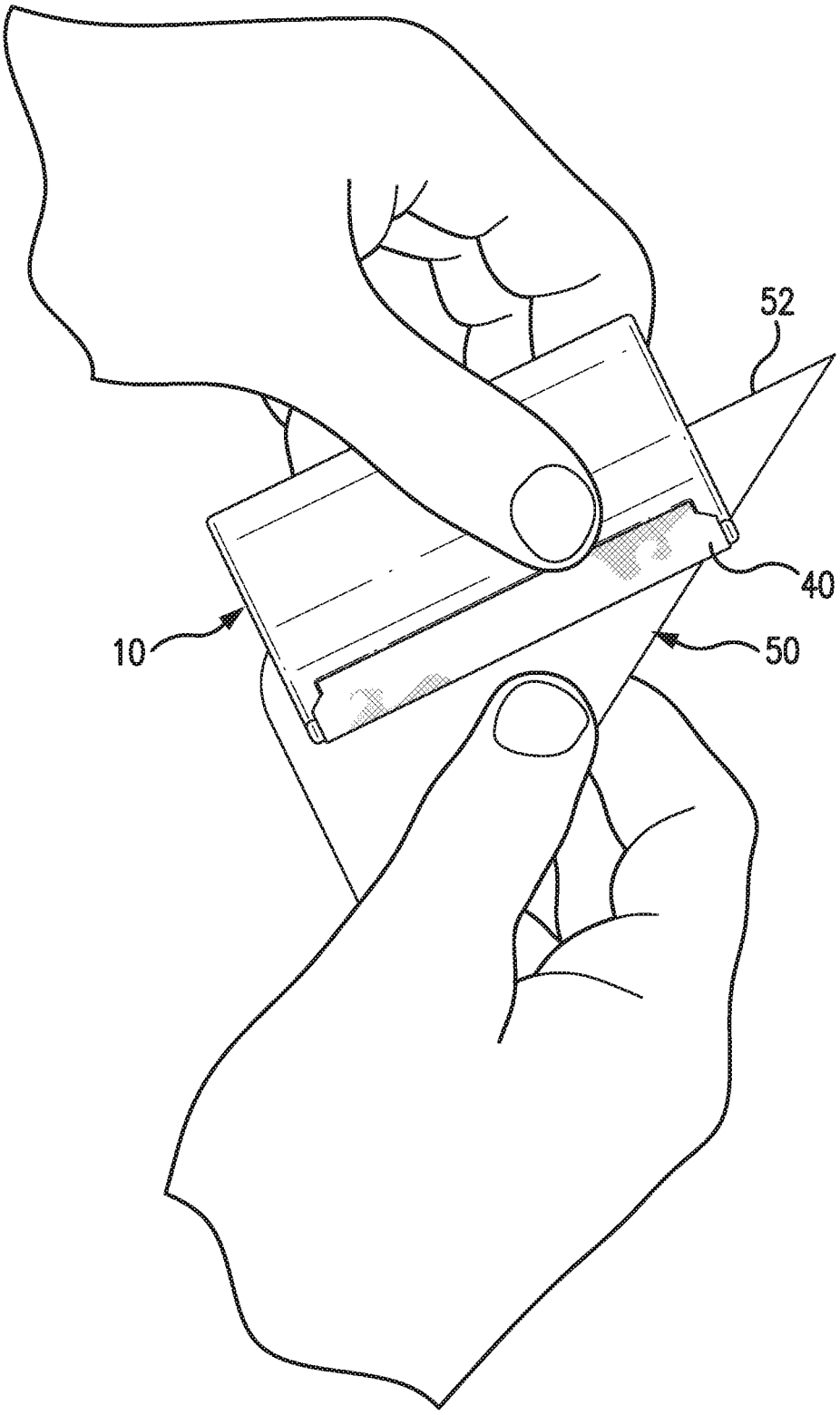
FIGS. 5 and 6 show a sequence of operation of use of the device of the present invention wherein the working edge of the squeegee or other tool is passed longitudinally between opposing panels of the device and in frictional engagement with the fabric sheet to effectively smooth the working edge of the squeegee or other tool.
Figure 6:
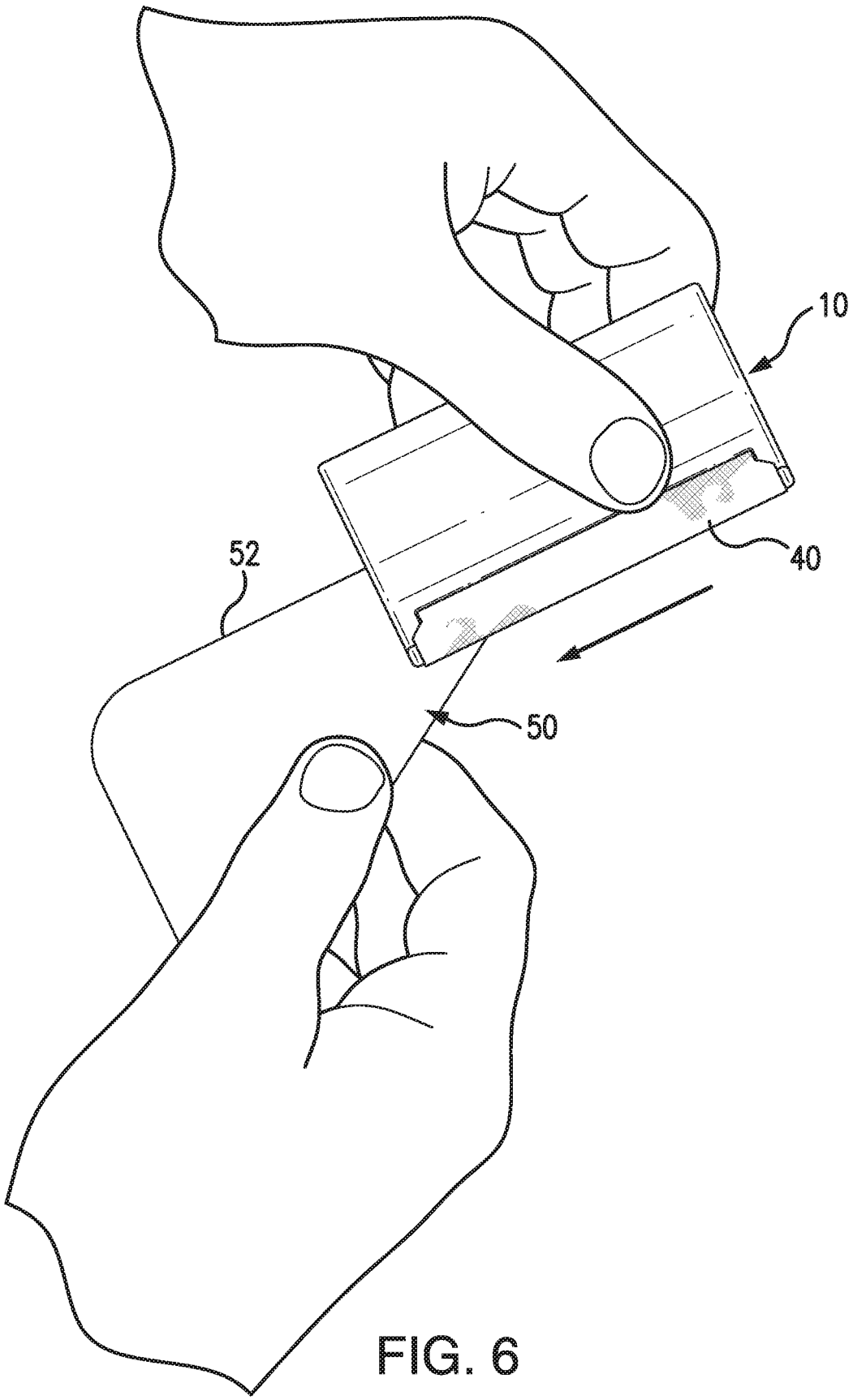

In use, the working edge 52 of the window tinting and graphics application tool 50 is received through the open mouth 30, and into engagement with the bottom 43 of the V-shape of the fabric sheet 40, as shown in FIGS. 3 and 4. Next, by moving the working edge 52 of the tool 50 longitudinally between the opposing panels 16, 18 and in frictional engagement with the fabric sheet 40, as seen in FIGS. 5 and 6, the working edge 52 of the tool 50 is smoothed, as bumps, nicks, scratches and other irregularities are removed from the working edge by the fabric sheet.

While the present invention has been shown and described in accordance with a preferred and practical embodiment, it is recognized that departures from the instant disclosure are fully contemplated within the spirit and scope of the present invention which is not to be limited except as defined in the following claims as interpreted under the Doctrine of Equivalents.

What is claimed is:

1. A device for smoothing a working edge of a squeegee tool that is used for application of film substrates to glass surfaces, the device comprising:

a main body including a base and opposing first and second panels extending away from the base and the first and second panels diverging away from one another and each terminating at a top distal edge to define an open mouth between the top distal edges of the opposing first and second panels;

the main body further including two symmetrical halves that are held together by at least one fastener, and the two symmetrical halves including a first half and a second half, the first half including a first portion of the base and the first panel, and the second half including a second portion of the base and the second panel, and the first portion of the base and the second portion of the base being joined together and held together by the at least one fastener to form the base of the main body;

the first and second halves of the main body each including an inboard facing side and an outboard facing side, and the first and second halves further including an arrangement of pegs on the inboard facing side of the base portions and a correspondingly aligned arrangement of receptacles on the inboard facing side of the base portions, wherein the arrangement of pegs are received within the correspondingly aligned arrangement of receptacles when the first and second base portions are joined together;

a fabric sheet having a first end portion secured to the main body and an opposite second end portion secured to the main body, and the fabric sheet further including a central portion tucked between the opposing first and second panels so that a transverse orientation of the central portion is in a V-shape, and the central portion including a top surface for frictional engagement with the working edge of the squeegee tool upon longitudinal movement of the working edge between the opposing first and second panels and against a top surface of the fabric sheet at a bottom of the V-shape;

the first and second end portions of the fabric sheet including an arrangement of holes for passage of the arrangement of pegs therethrough when the first and second base portions are joined together to thereby secure the first and second end portions to the main body; and the opposing first and second panels each including a longitudinal slot for passage of the fabric sheet therethrough and over the top distal edge and through the open mouth to assume the V-shape between the opposing first and second panels.

* * * * *